US008820657B2

(12) United States Patent
Baldrige

(10) Patent No.: US 8,820,657 B2
(45) Date of Patent: Sep. 2, 2014

(54) TEMPERATURE CHANGING DEVICE

(76) Inventor: Jordan Baldrige, Millersville, PA (US)

( * ) Notice: Subject to any disclaimer, the term of this patent is extended or adjusted under 35 U.S.C. 154(b) by 0 days.

(21) Appl. No.: 13/403,293

(22) Filed: Feb. 23, 2012

(65) Prior Publication Data

US 2012/0145372 A1 Jun. 14, 2012

Related U.S. Application Data

(63) Continuation-in-part of application No. 11/852,453, filed on Sep. 10, 2007, now abandoned.

(51) Int. Cl.

| | |
|---|---|
| ***A47G 21/18*** | (2006.01) |
| ***F28F 1/06*** | (2006.01) |
| ***F28F 1/00*** | (2006.01) |

(52) U.S. Cl.

CPC ..... *A47G 21/187* (2013.01); *A47G 21/183* (2013.01)

USPC ..... 239/33; 239/428.5; 165/177

(58) Field of Classification Search

CPC ... A47G 21/18; A47G 21/182; A47G 21/183; A47G 21/185; A47G 21/187; A47G 21/188; A47G 21/189

USPC ..... 239/12, 33, 428.5; 165/177; 30/141; 215/388, 389; 220/705–710

See application file for complete search history.

(56) References Cited

U.S. PATENT DOCUMENTS

| | | | | |
|---|---|---|---|---|
| 2,613,107 | A * | 10/1952 | Hartnett | 239/33 |
| 6,702,193 | B1 * | 3/2004 | Gates | 239/33 |
| 7,188,743 | B1 * | 3/2007 | Gates et al. | 215/389 |
| 7,537,173 | B1 * | 5/2009 | Kogan | 239/33 |

* cited by examiner

*Primary Examiner* — Darren W Gorman

(74) *Attorney, Agent, or Firm* — Mark David Torche Patwrite LLC

(57) ABSTRACT

A temperature changing device has a tubular member with a restricting portion that changes the air speed and pressure of liquids flowing there. An air inlet is provided to allow cooling or warming air to be drawn in and mix with the liquid in a mixing region. The air inlet is placed close to the bottom portion of the restricting portion. The restricting portion and inlet opening are placed far enough from the open top portion to allow for sufficient temperature change. In one embodiment, a stirring portion is provided to allow a user to stir a beverage such as coffee or tea.

1 Claim, 5 Drawing Sheets

TEMPERATURE CHANGING DEVICE

CROSS REFERENCE TO RELATED APPLICATIONS

This is a continuation in part of U.S. patent application Ser. No. 11/852,453, filed on Sep. 10, 2007, the complete disclosures of each of which are hereby incorporated by reference.

BACKGROUND OF THE INVENTION

It is often desirable to alter the temperature of a consumable liquid prior to the consumption thereof by a consumer. For example, it may desirable to cool a hot consumable liquid, such as coffee or broth, prior to the consumption thereof. Additionally, it may be desirable to warm a cold consumable liquid, such as a milkshake, prior to the consumption thereof. It is therefore desirable to provide a temperature changing device that can easily alter the temperature of the consumable liquid immediately prior to or simultaneous with the consumption of the consumable liquid by the consumer.

SUMMARY OF THE INVENTION

A temperature changing device has a tubular member with a restricting portion that changes the air speed and pressure of liquids flowing there. An air inlet is provided to allow cooling or warming air to be drawn in and mix with the liquid in a mixing region. The air inlet is placed close to the bottom portion of the restricting portion. The restricting portion and inlet opening are placed far enough from the open top portion to allow for sufficient temperature change. In one embodiment, a stirring portion is provided to allow a user to stir a beverage such as coffee or tea.

Other features and advantages of the instant invention will become apparent from the following description of the invention which refers to the accompanying drawings.

DETAILED DESCRIPTION OF THE INVENTION

Figure 1:
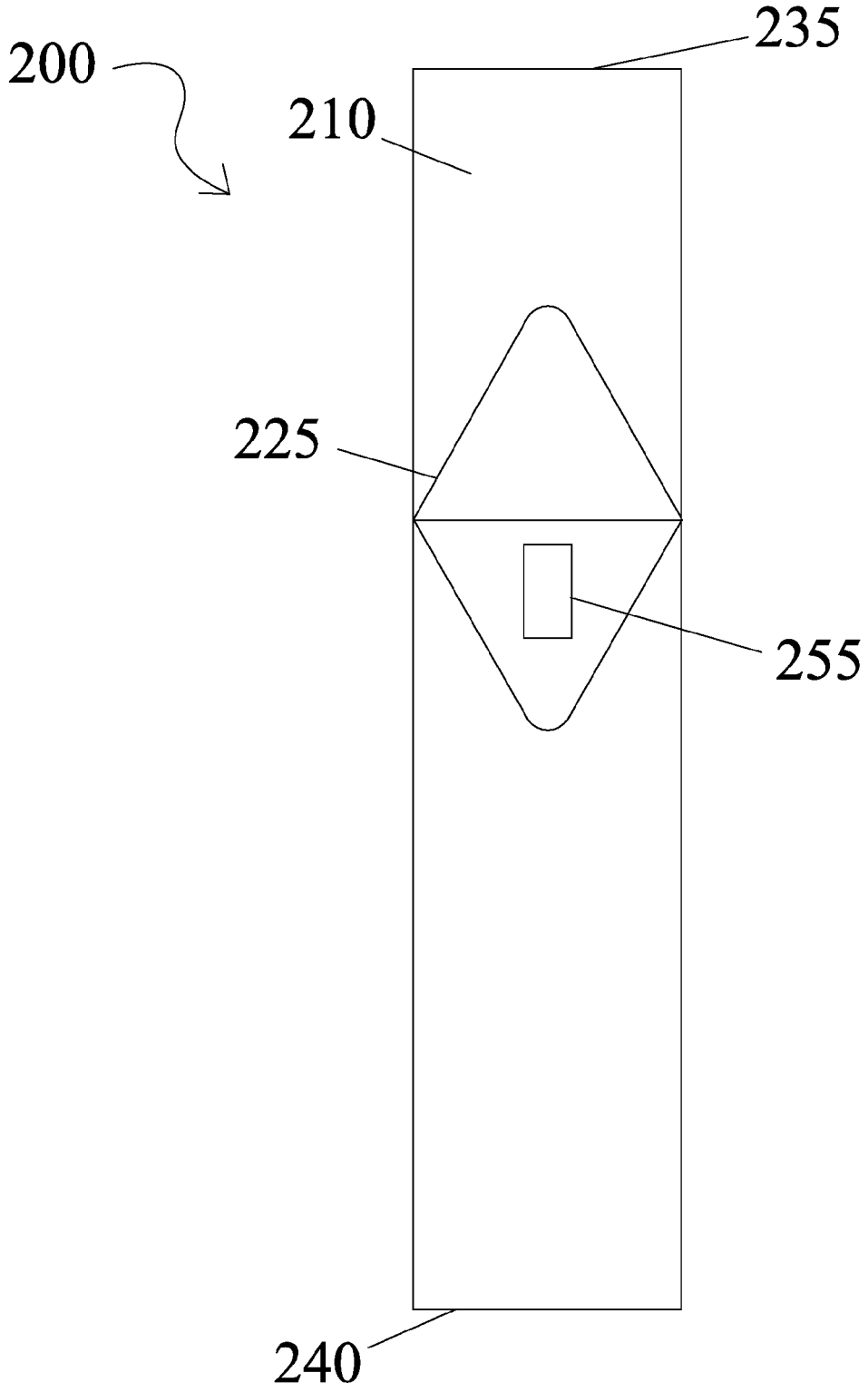
FIG. 1 is a front view of a temperature changing device according to an embodiment of the invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Figure 2:
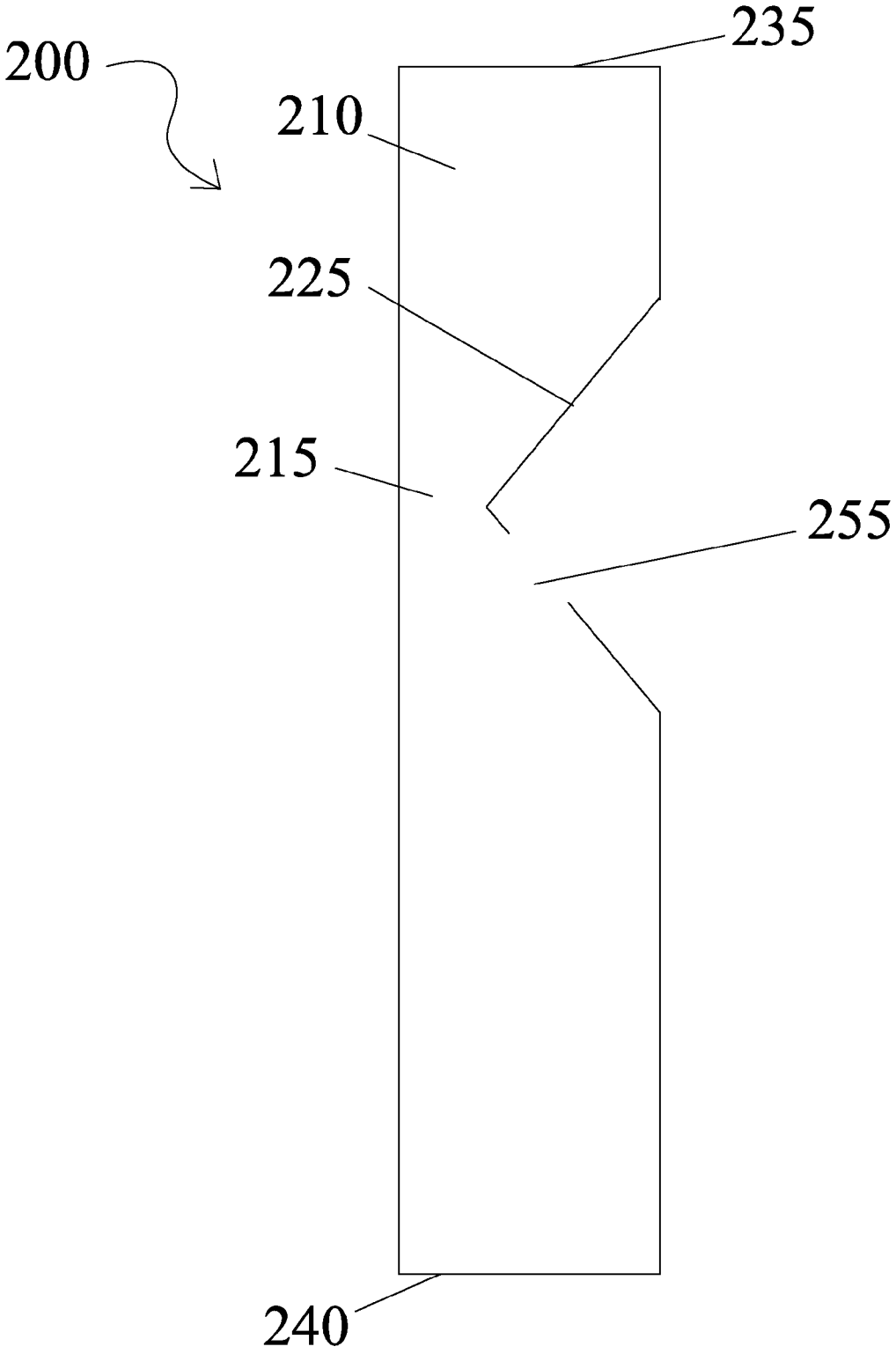
FIG. 2 is a side view of the temperature changing device shown in FIG. 1.

Now referring to FIGS. 1 and 2, a temperature changing device 200 is shown having a tubular member 210 with a restricting region 225. Single reducing region 225 is used to change the speed and pressure of the air and liquid according to Bernoulli's Principle. A single inlet opening 255 allows air to pass through where it mixes with the liquid in a mixing region 215. The liquid enters through an open bottom end 240 and is consumed as it passes out through open top end 235. Air that enters can either be cooling or warming depending on the temperature of the beverage being consumed. The air is generally at room temperature. Open bottom end 240 forms a first diameter which is larger than the diameter of single reducing portion 225. Single reducing portion 225 forms a second smaller diameter portion with respect to the first diameter portion. The single reducing portion 225 includes a centrally disposed minimum diameter with an upper portion defining a surface starting at the minimum diameter and terminating with a portion having the same diameter as the first diameter, and a lower portion defining a surface starting at the minimum diameter and terminating with a portion having the same diameter as the first diameter.

The tubular member 210 is made of plastic, but can also be made of any suitable material such as, but not limited to paper, metal, rubber, etc. as long as a reducing portion is present and an inlet opening is placed below that reducing portion can be proximally placed to a mixing region. The inlet opening and reducing portion should be placed far enough from the open top portion to allow the liquid to change temperature sufficiently. The farther down the reducing portion and inlet opening is placed, the greater the temperature change.

Figure 3:
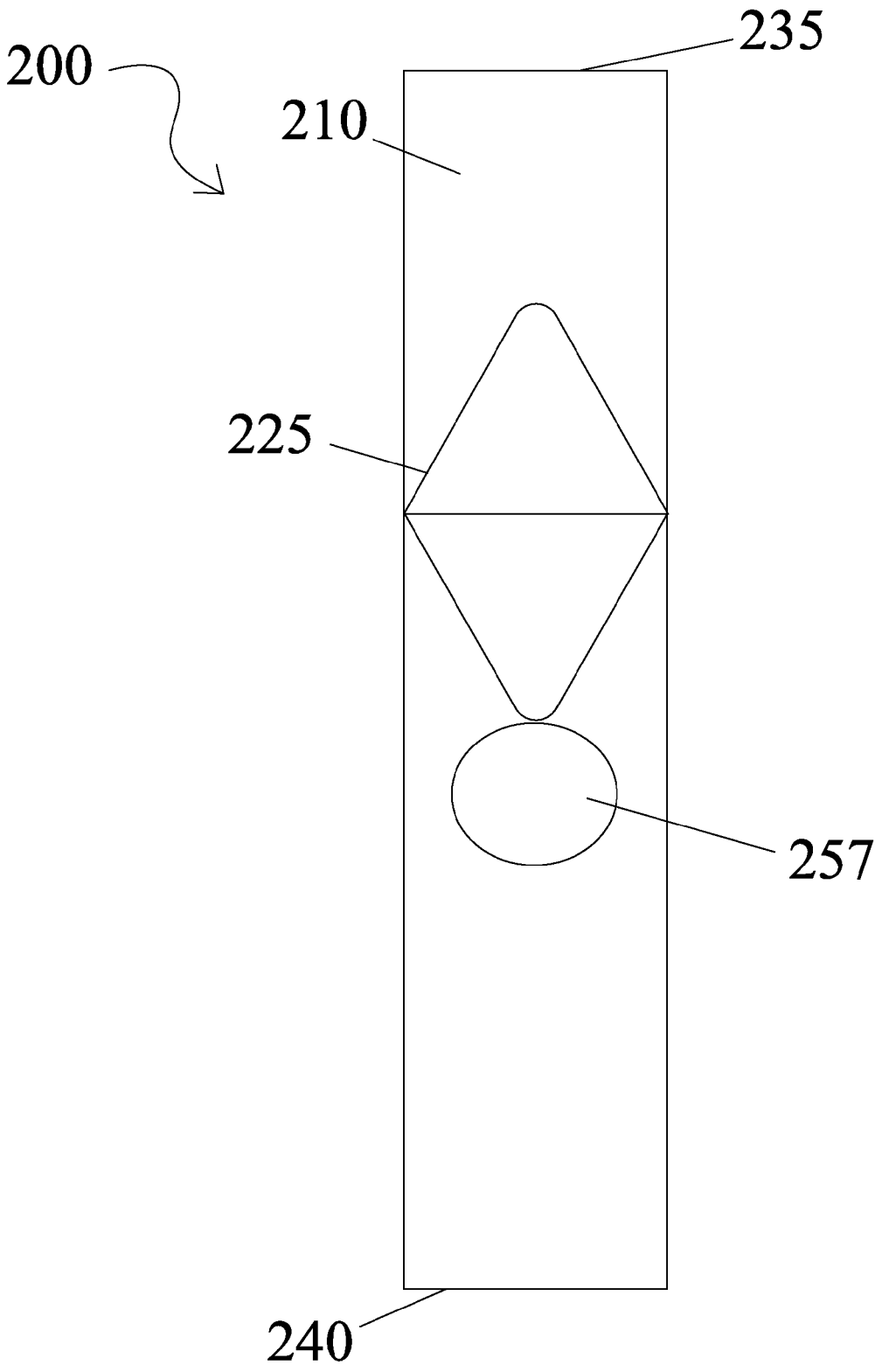
FIG. 3 is a front view of a temperature changing device according to an embodiment of the invention.

Referring now to FIG. 3, temperature changing device 200 has an inlet opening 257 placed below reducing region 225 and mixing region 215. It is easier to manufacture in this configuration.

Figure 4:
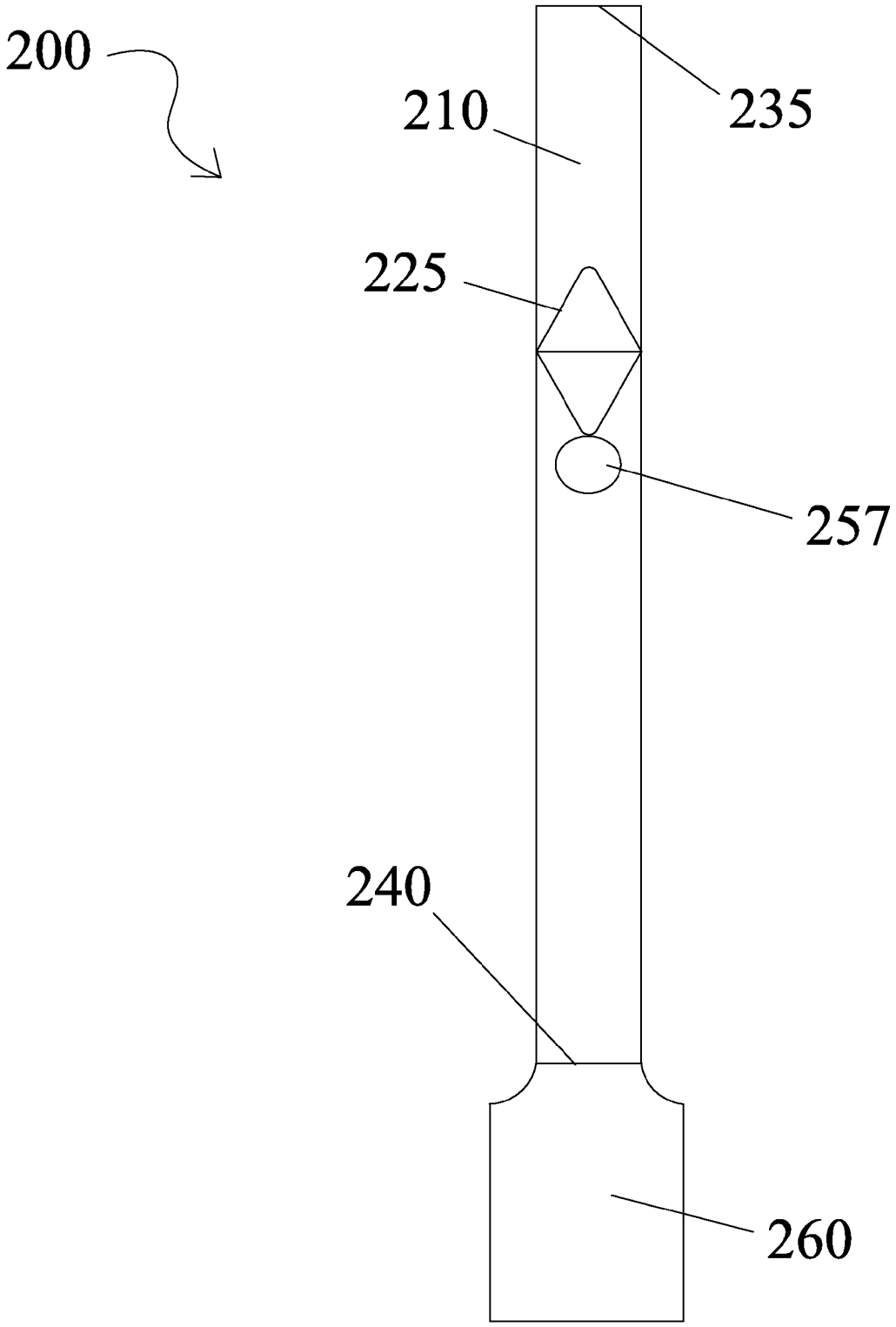
FIG. 4 is a front view of the temperature changing device shown in FIG. 3 with a stirrer portion.
Figure 5:
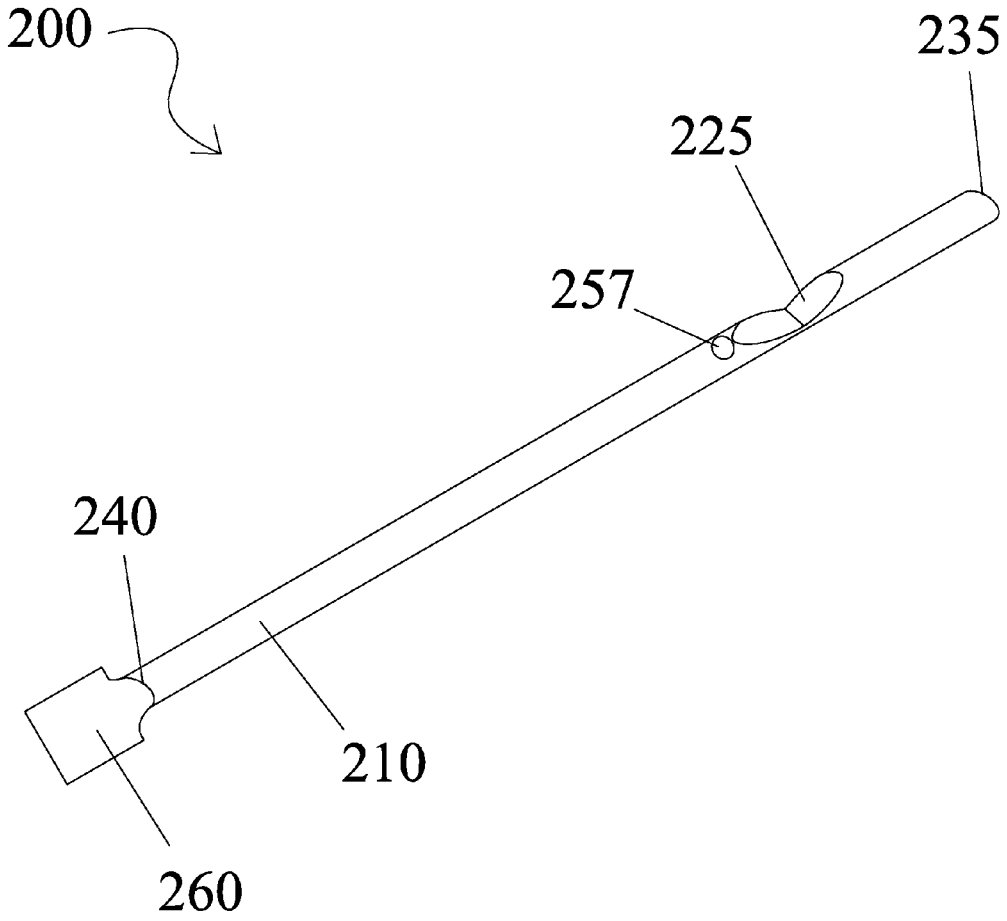
FIG. 5 is a perspective view of the temperature changing device shown in FIG. 4.

Now referring to FIGS. 4 and 5, temperature changing device 200 is shown having a stirring portion 260 that allows temperature changing device 200 to also function as a stirrer for beverages like coffee or tea. Again, as discussed above, air is introduced through inlet opening 257 and is mixed with the beverage to change the temperature of the liquid to comfortable and safe drinking temperature.

Although the instant invention has been described in relation to particular embodiments thereof, many other variations and modifications and other uses will become apparent to those skilled in the art.

What is claimed is:

1. A temperature changing device for use with beverage to change the temperature of the beverage, comprising:

a tubular member having an open bottom end and an opposite open top end;

said tubular member having a first diameter;

a single reducing portion disposed in an upper portion of said tubular member wherein said reducing portions forms a second smaller diameter portion;

said reducing portion having a centrally disposed minimum diameter with an upper portion defining a surface starting at said minimum diameter and terminating with a portion having the same diameter as said first diameter;

said reducing portion further having a lower portion defining a surface starting at said minimum diameter and terminating with a portion, having the same diameter as said first diameter; and a single inlet opening disposed within said lower portion of said reducing portion, wherein air is drawn in therein and mixes with said beverage to change a temperature thereof as a user draws said beverage up through said tubular member from said open bottom end to said open top end.

* * * * *